US011725287B2

(12) United States Patent
Ueda et al.

(10) Patent No.: US 11,725,287 B2
(45) **Date of Patent: *Aug. 15, 2023**

(54) METHOD FOR MANUFACTURING A MAGNESIUM MATERIAL OR MAGNESIUM ALLOY MATERIAL WITH A COATING

(71) Applicant: Nihon Parkerizing Co., Ltd., Tokyo (JP)

(72) Inventors: Yukihiro Ueda, Tokyo (JP); Ryoko Katsuraya, Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 609 days.

This patent is subject to a terminal disclaimer.

(21) Appl. No.: 16/922,072

(22) Filed: Jul. 7, 2020

(65) Prior Publication Data

US 2020/0340123 A1 Oct. 29, 2020

Related U.S. Application Data

(62) Division of application No. 16/064,511, filed as application No. PCT/JP2016/088312 on Dec. 22, 2016, now abandoned.

(30) Foreign Application Priority Data

Dec. 25, 2015 (JP) ..... 2015-254045

(51) Int. Cl.

| | |
|---|---|
| ***C23C 22/57*** | (2006.01) |
| ***C23C 22/07*** | (2006.01) |
| ***C23C 22/78*** | (2006.01) |
| ***C23C 22/22*** | (2006.01) |
| *C23C 22/05* | (2006.01) |

(52) U.S. Cl.
CPC ..... *C23C 22/78* (2013.01); *C23C 22/07* (2013.01); *C23C 22/22* (2013.01)

(58) Field of Classification Search
CPC ..... C23C 22/57
See application file for complete search history.

(56) References Cited

U.S. PATENT DOCUMENTS

| | | | |
|---|---|---|---|
| RE16,340 | E | 5/1926 | Backer |
| 6,361,623 | B1 | 3/2002 | Ishikura et al. |
| 2004/0011429 | A1 | 1/2004 | Miyamoto et al. |
| 2006/0013921 | A1 | 1/2006 | Kasahara et al. |
| 2007/0240604 | A1 | 10/2007 | Inbe et al. |
| 2011/0046239 | A1 | 2/2011 | Keiser et al. |
| 2015/0374751 | A1 | 12/2015 | Delaney et al. |
| 2017/0304156 | A1 | 10/2017 | Jha et al. |

FOREIGN PATENT DOCUMENTS

| | | | | |
|---|---|---|---|---|
| CN | 1470672 | A | 1/2004 | |
| CN | 101191207 | A | 6/2008 | |
| CN | 101243206 | A | 8/2008 | |
| CN | 101274494 | | 10/2008 | |
| CN | 101565825 | A | 10/2009 | |
| CN | 104947097 | A | 9/2015 | |
| EP | 1930474 | A1 | 6/2008 | |
| EP | 1930475 | A1 | 6/2008 | |
| GB | 1222163 | A | 2/1971 | |
| JP | 62-074970 | | 4/1987 | |
| JP | H11-006076 | A | 1/1999 | |
| JP | 2002121681 | A | 4/2002 | |
| JP | 3783995 | B2 | 6/2006 | |
| JP | 3845328 | B2 | 11/2006 | |
| JP | 2009-029693 | A | 2/2009 | |
| JP | 2015-151565 | * | 8/2015 | ..... C23C 8/16 |
| KR | 1998-0079984 | A | 11/1998 | |
| KR | 2005-0089150 | A | 9/2005 | |
| WO | WO-98/39498 | A1 | 9/1998 | |
| WO | WO-00/70123 | A1 | 11/2000 | |

OTHER PUBLICATIONS

International Application No. PCT/JP2016/088312, International Search Report (English translation), dated Mar. 21, 2017.
International Application No. PCT/JP2016/088312, Written Opinion (English translation), dated Mar. 21, 2017.
Bing Wang et al., International Journal of Molecular Sciences, vol. 14, 2013, pp. 23614-23628.
International Application No. KR 10-2018-7018842, Office Action dated Nov. 19, 2018.
Ren-xin Liu, "Practice and Theoretic Discussion in Phosphating Surface Adjust Agents", Modern Paint & Finishing, vol. 13, No. 5, 2010, pp. 44-49.
Office Action in CN Application No. 201680074828.9 dated Jan. 3, 2019, 7 pages.
Office Action in KR Application No. 10-2018-7018842 dated Jun. 24, 2019, 4 pages.
Extended European Search Report in EP Application No. 16878873.5 dated Aug. 8, 2019, 7 pages.
Office Action in CN Application No. 201680074828.9 dated Nov. 8, 2019, 10 pages.
In Vitro Corrosion and Cytocompatibility of ZK60 Magnesium Alloy Coated with Hydroxyapatite by a Simple Chemical Conversion Process for Orthopedic Applications; Bing Wang, Ping Huang, Caiwen Ou,t, Kaikai Li, Biao Yan and Wei Lu; Int. J. Mol. Sci. 2013, 14, 23614-23628 (Year: 2013).

(Continued)

*Primary Examiner* — Lois L Zheng

(74) *Attorney, Agent, or Firm* — Marshall, Gerstein & Borun LLP

(57) ABSTRACT

This invention provides a technique that enables a chemical conversion coating excellent in adhesiveness and corrosion resistance to be formed on or over a magnesium material or magnesium alloy material and use of the technique. The above object is achieved by performing a surface conditioning treatment by using a surface conditioning agent that includes specific dibasic calcium phosphate particles before performing a chemical conversion for forming the chemical conversion coating.

2 Claims, No Drawings

(56) References Cited

OTHER PUBLICATIONS

Shaylin Shadanbaz, Jemimah Walker,Tim B. F. Woodfield, Mark P. Staiger,George J. Dias; Accepted : Sep. 19, 2013; Springer Science+ Business Media New York 2013 ;J. Mater Sci: Mater Med DOI 10.1007/s10856-013-5059-2 (Year: 2013).

Bing Wang, Ping Huang, Caiwen Ou, Kaikai Li, Biao Yan and Wei Lu; In Vitro Corrosion and Cytocompatibility of ZK60 Magnesium Alloy Coated with Hydroxyapatite by a Simple Chemical Conversion Process for Orthopedic Applications; Int. J. Mol. Sci 2013, 14, 23614-23628 (Year: 2013).

Office Action in CN Application No. 202010662034.2 dated Aug. 18, 2021, 7 pages.

Office Action in EP Application No. 16878873.5 dated Jul. 2, 2020, 4 pages.

* cited by examiner

METHOD FOR MANUFACTURING A MAGNESIUM MATERIAL OR MAGNESIUM ALLOY MATERIAL WITH A COATING

CROSS-REFERENCE TO RELATED APPLICATIONS

This application is a divisional of U.S. application Ser. No. 16/064,511 filed Jun. 21, 2018, which is the U.S. National Stage of International Application No. PCT/JP2016/088312 filed Dec. 22, 2016, which in turn claims the priority benefit of JP Application No. 2015-254045 filed Dec. 25, 2015, the entire respective disclosures of which are incorporated herein by reference.

TECHNICAL FIELD

The present invention relates to a surface conditioning agent for use in a surface treatment for a magnesium material or magnesium alloy material that is performed before a chemical conversion, and also to a method for manufacturing a magnesium material or magnesium alloy material with a coating, including a surface treatment step using the surface conditioning agent and a chemical conversion step. Additionally, the invention relates to a magnesium material or magnesium alloy material with a coating that includes crystalline particles of dibasic calcium phosphate.

BACKGROUND ART

Magnesium materials and magnesium alloy materials (which mean metal materials containing magnesium as a main component; and hereinafter, magnesium materials, magnesium alloy materials, and the like are referred to as "magnesium-containing metal materials") have low specific gravity, are tough, and are excellent in recyclability. Thus, they are widely used as materials for various industrial parts of automobiles, bicycles, fishing gears, home appliances (such as laptop computers and mobile phones), and the like. On the other hand, among practically used metals, magnesium-containing metal materials are those easily susceptible to corrosion. Therefore, magnesium-containing metal materials are subjected to chemical conversion in order to impart corrosion resistance thereto.

For chemical conversion-related techniques, some proposals have already been made. For example, Patent Document 1 discloses a surface treatment method for magnesium alloys including a step of contacting a magnesium alloy cast product that has been subjected to predetermined treatments with (1) an acidic aqueous solution that has a pH of 2 to 6 and that contains orthophosphoric acid and at least one predetermined metal ions or (2) an acidic aqueous solution that has a pH of 2 to 6 and that contains at least one predetermined fluorine compound and at least one predetermined metal oxyacid compound.

Additionally, Patent Document 2 discloses a method for forming a chemical conversion coating of a magnesium alloy including a step of performing a chemical conversion by using a solution containing calcium ions, manganese ions, and phosphate ions on a surface of a magnesium alloy that has been subjected to a predetermined etching treatment and that has an aluminum content of 7.5% by mass or less.

PRIOR ART

Patent Document

[Patent Document 1]: Japanese Patent No. 3783995
[Patent Document 2]: Japanese Patent No. 3845328

SUMMARY OF THE INVENTION

Problem to be Solved by the Invention

However, conventional techniques relating to chemical conversion have sometimes failed to form a chemical conversion coating excellent in adhesiveness and corrosion resistance on a magnesium-containing metal material.

The present invention solves the above problem, and it is an object of the invention to provide a technique that enables a chemical conversion coating excellent in adhesiveness and corrosion resistance to be formed on or over a magnesium-containing metal material and use of the technique.

Means for Solving the Problem

The present inventors have conducted intensive and extensive studies regarding means for solving the above problem, and have consequently found that, by performing a surface conditioning treatment by using a surface conditioning agent that includes particles of dibasic calcium phosphate having a specific particle size before a chemical conversion, a chemical conversion coating excellent in adhesiveness and corrosion resistance can be formed on or over a magnesium-containing metal material, whereby the present inventors have completed the present invention.

Specifically, the present invention includes:

(1) a surface conditioning agent including particles of dibasic calcium phosphate, the particles of dibasic calcium phosphate having a $D_{50}$ of from 0.1 μm to 0.8 μm, and the dibasic calcium phosphate being monetite and/or brushite;

(2) a method for manufacturing a magnesium material or magnesium alloy material with a coating, the method including:

a step of contacting a magnesium material or magnesium alloy material with the surface conditioning agent according to the above (1); and a step of contacting the magnesium material or magnesium alloy material that has been contacted with the surface conditioning agent with a surface treatment agent including a phosphate ion and a calcium ion; and (3) a magnesium material or magnesium alloy material with a coating, including a coating that includes crystalline particles of dibasic calcium phosphate and that is provided on or over a surface of a magnesium material or magnesium alloy material, the crystalline particles of dibasic calcium phosphate having an average particle size of from 0.7 μm to 25 μm and having a particle size distribution standard deviation of 5 or less, and the dibasic calcium phosphate being monetite and/or brushite.

Advantageous Effects of the Invention

The present invention can provide a technique that enables a chemical conversion coating excellent in adhesiveness and corrosion resistance to be formed on a magnesium-containing metal material and use of the technique.

EMBODIMENT FOR CARRYING OUT THE INVENTION

Hereinafter, a detailed description will be given of a surface conditioning agent, a magnesium-containing metal material with a coating, and a manufacturing method therefor according to embodiments of the present invention.

<Surface Conditioning Agent>

A surface conditioning agent according to an embodiment of the present invention is a pretreatment agent for efficiently forming a chemical conversion coating including dibasic calcium phosphate on or over a magnesium-containing metal material. The surface conditioning agent includes particles of dibasic calcium phosphate that have a specific particle size. By performing a surface conditioning treatment using such a surface conditioning agent before a chemical conversion using a surface treatment agent that includes a phosphate ion and a calcium ion, the above-mentioned chemical conversion coating excellent in adhesiveness and corrosion resistance can be formed.

The surface conditioning agent according to the present embodiment may include other components than the dibasic calcium phosphate particles as long as the advantageous effects of the invention can be exhibited, or may include only a solvent and the dibasic calcium phosphate particles.

(Particles of Dibasic Calcium Phosphate)

Dibasic calcium phosphate is also called calcium monohydrogen phosphate. Dibasic calcium phosphate is available in forms of anhydrate ($CaHPO_4$) and dihydrate ($CaHPO_4 \cdot 2H_2O$), and the anhydrate and the dihydrate are called monetite and brushite, respectively.

The surface conditioning agent according to the present embodiment may include at least one of monetite or brushite, or may include both of them. Additionally, when the surface conditioning agent includes both thereof, a content ratio between them is not particularly limited.

The dibasic calcium phosphate may be crystalline dibasic calcium phosphate or amorphous dibasic calcium phosphate, but, usually, crystalline dibasic calcium phosphate is used.

Additionally, the dibasic calcium phosphate may be a commercially available product, or may be produced from a phosphoric acid raw material and a calcium raw material. As a method for producing dibasic calcium phosphate, for example, a phosphoric acid aqueous solution is reacted with a calcium raw material such as calcium carbonate or calcium hydroxide, and pH is adjusted to from 4 to 5 to obtain a dibasic calcium phosphate. In this case, setting reaction temperature to at least 80° C. or more enables production of monetite, while setting reaction temperature to at least 60° C. or less enables production of brushite. Note that even at a temperature of below 80° C., monetite may be obtained, while even at a temperature higher than 60° C., brushite may be obtained.

The dibasic calcium phosphate particles usually have a $D_{50}$ of 0.1 μm or more, and may have a $D_{50}$ of 0.2 μm or more or 0.3 μm or more. Additionally, the upper limit of the $D_{50}$ is usually 0.8 μm or less, may be 0.6 μm or less, or may be 0.5 μm or less. By performing a surface conditioning treatment by using the surface conditioning agent including the dibasic calcium phosphate particles having a $D_{50}$ within the above range, a chemical conversion coating excellent in adhesiveness and corrosion resistance can be formed by performing the above-mentioned chemical conversion after that.

Additionally, the dibasic calcium phosphate particles usually have a $D_{90}$ of 0.15 μm or more, and may have a $D_{90}$ of 0.2 μm or more or 0.3 μm or more. In addition, the upper limit of the $D_{90}$ is usually 1.5 μm or less, may be 1.2 μm or less, or may be 1.0 μm or less. By performing a surface conditioning treatment by using the surface conditioning agent including the dibasic calcium phosphate particles having a $D_{90}$ within the above range, a highly uniform coating can be formed by performing the above-mentioned chemical conversion after that.

The $D_{50}$ and the $D_{90}$, respectively, represent particle sizes located at 50% by volume and 90% by volume on a cumulative curve of particles obtained by assuming that a total volume of the particles of dibasic calcium phosphate in the surface conditioning agent is 100%. The particle size distribution of the dibasic calcium phosphate particles in the surface conditioning agent can be obtained, for example, by analyzing intensity of light scattering from the particles irradiated with laser light and a diffraction image produced on a focal plane by collecting the light by a lens. Additionally, from the obtained particle size distribution, particle sizes located at 50% by volume and 90% by volume can be obtained.

Sizes of the dibasic calcium phosphate particles can be adjusted by a usual method such as a wet pulverization method. More specifically, adjustment can be made by pulverizing a mixture of water, a dispersant, and the dibasic calcium phosphate particles in a bead mill. Note that the mass concentration of the dibasic calcium phosphate particles in the mixture is not particularly limited, but preferably is from 5 to 50% by weight.

(Dispersant)

Examples of the dispersant include monosaccharides, polysaccharides, or derivatives thereof; normal phosphoric acids, polyphosphoric acids, or salts thereof, or organic phosphonic acid compounds or salts thereof; water-soluble polymer compounds composed of vinyl acetate polymers or derivatives thereof or copolymers of monomers copolymerizable with vinyl acetate and vinyl acetate; and polymers or copolymers obtained by polymerizing at least one or more monomers selected from monomers represented by Formula: $H_2C{=}C(R^1){-}COOR^2$ (in which $R^1$ represents H or $CH_3$; $R^2$ represents H, an alkyl group having 1 to 5 carbon atoms, or a hydroxyalkyl group having 1 to 5 carbon atoms) or alpha, beta-unsaturated carboxylic acid monomers and 50% by weight or less of monomers copolymerizable with the monomers.

Examples of basic constituent saccharides of the above-mentioned monosaccharides, polysaccharides, or derivatives thereof include fructose, tagatose, psicose, thulbose, erythrose, threose, ribose, arabinose, xylose, lyxose, allose, altrose, glucose, mannose, gulose, idose, galactose, and talose.

In use of monosaccharides, the basic constituent saccharides themselves can be used, and in use of polysaccharides, homopolysaccharides or heteropolysaccharides of the basic constituent saccharides can be used. Additionally, as the derivatives thereof, there can be used monosaccharides obtained by etherifying hydroxyl groups of the basic constituent saccharides with substituents such as $NO_2$, $CH_3$, $C_2H_4OH$, $CH_2CH(OH)CH_3$, and $CH_2COOH$ and homopolysaccharides and heteropolysaccharides structurally including the monosaccharides substituted with the substituents. Alternatively, several kinds of monosaccharides, polysaccharides, and the derivatives thereof may be used in combination.

In classifying saccharides, saccharides are sometimes classified into monosaccharides, oligosaccharides, and polysaccharides depending on the degree of hydrolysis. However, in the present invention, it has been considered that saccharides that are hydrolyzed to produce two or more monosaccharides are polysaccharides, and saccharides themselves that cannot be hydrolyzed any further are monosaccharides.

Since use for the present invention is unrelated to any biochemical reactions, the effects are not influenced by configuration and optical performance properties of the basic constituent saccharides, and any combination of D-monosaccharide, L-monosaccharide, and optical performance properties (+, −) can be used. Additionally, in order to enhance water solubility of monosaccharides, polysaccharides, and derivatives thereof, sodium salts or ammonium salts of the monosaccharides, the polysaccharides, and the derivatives thereof may be used. Furthermore, if water solubilization is difficult in the above structure, they may be used after being previously dissolved in an organic solvent having compatibility with water.

The normal phosphoric acids are orthophosphoric acids. Examples of the polyphosphoric acids that can be used include pyrophosphoric acid, triphosphoric acid, trimetaphosphoric acid, tetrametaphosphoric acid, hexametaphosphoric acid, or sodium salts thereof, and ammonium salts thereof. Additionally, examples of the organic phosphonic acid compounds that can be used include aminotrimethylene phosphonic acid, 1-hydroxyethylidene-1,1-diphosphonic acid, ethylenediamine tetramethylene phosphonic acid, diethylene triamine pentamethylene phosphonic acid, or sodium salts thereof. Note that the normal phosphoric acids, polyphosphoric acids, and organic phosphonic acid compounds may be used singly or in combination of two or more of the same.

Examples of the vinyl acetate polymers or derivatives thereof that can be used include polyvinyl alcohols that are saponified products of vinyl acetate polymers, cyanoethylated polyvinyl alcohols obtained by cyanoethylating polyvinyl alcohols by acrylonitrile, formalized polyvinyl alcohols obtained by acetalizing polyvinyl alcohols by formalin, urethanized polyvinyl alcohols obtained by urethanizing polyvinyl alcohols by urea, and water-soluble polymer compounds obtained by introducing a carboxyl group, a sulfone group, an amide group, or the like into polyvinyl alcohols. Herein, water solubility means properties in which 0.1 g or more of a substance is dissolved in 100 g of water at 25° C. or properties in which a mixture of the substance and water is transparent (hereinafter the same in the present specification). Additionally, examples of the monomers copolymerizable with vinyl acetate that can be used include acrylic acid, crotonic acid, and maleic anhydride.

The vinyl acetate polymers or derivatives thereof or the copolymers of monomers copolymerizable with vinyl acetate and vinyl acetate can sufficiently exert their effects in the present invention as long as they are water-soluble. Accordingly, the effects are not influenced by polymerization degree thereof and functional group introduction rate. Note that the vinyl acetate polymers or derivatives thereof and the copolymers may be used singly, or in combination of two or more of the same.

Examples of the usable monomers represented by the above formula include methyl acrylate, ethyl acrylate, propyl acrylate, butyl acrylate, pentyl acrylate, methyl methacrylate, ethyl methacrylate, propyl methacrylate, butyl methacrylate, pentyl methacrylate, hydroxymethyl acrylate, hydroxyethyl acrylate, hydroxypropyl acrylate, hydroxybutyl acrylate, hydroxypentyl acrylate, hydroxymethyl methacrylate, hydroxyethyl methacrylate, hydroxypropyl methacrylate, hydroxybutyl methacrylate, and hydroxypentyl methacrylate.

Additionally, examples of the usable alpha, beta-unsaturated carboxylic acid monomers include acrylic acid, methacrylic acid, and maleic acid. Examples of the usable monomers copolymerizable with the monomers include vinyl acetate, styrene, vinyl chloride, and vinyl sulfonic acid. Alternatively, a polymer obtained by polymerizing one of the monomers may be used. Alternatively, a copolymer obtained by polymerizing a combination of some of the monomers may be used.

(Solvent)

The solvent is not particularly limited as long as it allows dibasic calcium phosphate to be suitably dispersed therein, but, usually, water is used. An organic solvent may be added to water. In that case, an organic solvent content with respect to the entire solvent amount is usually 10% by weight or less, and may be 5% by weight or less, or may be 3% by weight or less.

The kind of the organic solvent is not particularly limited, and there may be mentioned alcohol-based organic solvents, hydrocarbon-based organic solvents, ketone-based organic solvents, and amide-based organic solvents.

A dibasic calcium phosphate particle content in the surface conditioning agent is usually 0.05 g/L or more, and may be 0.1 g/L or more, as a solid content concentration. In addition, the upper limit of the content is usually 20 g/L or less, and may be 10 g/L or less, or may be 5 g/L or less. When the content is within the above range, dispersibility of the dibasic calcium phosphate particles in the surface conditioning agent is favorable.

(Other Components)

The surface conditioning agent may include a thickener, a dispersion stability enhancer, a pH adjuster, and the like, as needed.

The thickener can ensure dispersibility of the dibasic calcium phosphate particles in the surface conditioning agent to prevent caking due to sedimentation of the dibasic calcium phosphate particles. The kind of the thickener is not particularly limited, and examples thereof include natural polymers such as proteins, natural rubbers, sugars (including sugar derivatives), alginates, and celluloses; synthetic polymers such as amine-based resins, carboxylic acid-based resins, olefin-based resins, ester-based resins, urethane-based resins, PVA, and acrylic (methacrylic) resins, or such as copolymers obtained by copolymerizing two or more kinds of these resins in combination; various kinds of surfactants such as nonionic surfactants, cationic surfactants, anionic surfactants, and amphoteric surfactants; and various kinds of coupling agents such as silane coupling agents and titanium coupling agents.

A thickener content in the surface conditioning agent is usually 0.1% by weight or more, and may be 0.5% by weight or more, from the viewpoint of maintaining favorable dispersibility. Additionally, the upper limit of the thickener content is usually 20% by weight or less, and may be 10% by weight or less.

A dispersion stability enhancer is an agent for enhancing dispersion stability of the dibasic calcium phosphate particles in the surface conditioning agent. Examples of the dispersion stability enhancer include condensed phosphate alkaline salts such as sodium polyphosphate, potassium polyphosphate, sodium metaphosphate, potassium metaphosphate, sodium pyrophosphate, and potassium pyrophosphate.

The pH adjuster is an agent for adjusting the pH of the surface conditioning agent to within a predetermined range. The kind of the pH adjuster is not particularly limited, and examples thereof include phosphate-based alkaline additives such as disodium hydrogen phosphate hydrates, dipotassium hydrogen phosphate, magnesium hydrogen phosphate hydrates, and diammonium hydrogen phosphate; and carbonate-based alkaline additives such as sodium carbonate, potassium carbonate, basic magnesium carbonate hydrates, ammonium hydrogen carbonate, and calcium carbonate.

The pH of the surface conditioning agent is adjusted to usually from 6 to 11. The lower limit of the pH thereof may be 7 or more, and the upper limit of the pH thereof may be 10 or less or 9 or less. Herein, the term pH in the present specification represents a value obtained by measuring the surface conditioning agent at 25° C. by a commercially available pH meter.

<Method for Manufacturing Surface Conditioning Agent>

The surface conditioning agent according to the present embodiment can be manufactured, for example, by adjusting the pH of a mixture obtained by mixing the dibasic calcium phosphate particles and, if necessary, a dispersant in a solvent to a predetermined pH by a pH adjuster, subsequently wet-pulverizing the mixture subjected to the pH adjustment, and then stirring the mixture to disperse the dibasic calcium phosphate particles. Alternatively, the surface conditioning agent of the embodiment can be manufactured by adjusting the pH of a mixture obtained by mixing the dibasic calcium phosphate particles having a previously adjusted predetermined size and, if necessary, a dispersant in a solvent to a predetermined pH by a pH adjuster. Note that although the dispersant and the pH adjuster have previously been mixed in the dibasic calcium phosphate particles before the wet pulverization in the above description, either one thereof may be mixed with the dibasic calcium phosphate particles before wet pulverization, then wet-pulverized, and the other one thereof may be mixed with the dibasic calcium phosphate particles after that. Alternatively, after wet pulverization, the dispersant and the pH adjuster may be mixed with the dibasic calcium phosphate particles.

The order of addition of the raw materials to the solvent is not particularly limited. The dibasic calcium phosphate, the dispersant, and the pH adjuster may be added all together, or the dibasic calcium phosphate may be added to the solvent that contains only the dispersant, and, if necessary, the pH adjuster may be added.

Wet pulverization for adjusting the sizes of the particles can be performed using, for example, a bead mill, but not limited thereto. Pulverization time is not particularly limited, and wet pulverization can be performed until a desired particle size is obtained.

<Method for Manufacturing Coating>

Another embodiment of the present invention is a magnesium-containing metal material with a coating, in which the coating is a chemical conversion coating. The chemical conversion coating includes crystalline particles of dibasic calcium phosphate. A method for manufacturing the magnesium-containing metal material with the chemical conversion coating includes a first contact step of contacting a surface of a magnesium-containing metal material with the above-described surface conditioning agent and a second contact step of contacting the magnesium-containing metal material that has been contacted with the surface conditioning agent with a surface conditioning agent including a phosphate ion and a calcium ion. Note that the first contact step is hereinafter referred to as surface conditioning treatment step, and the second contact step is hereinafter referred to as chemical conversion step.

Performing the surface conditioning treatment step before the chemical conversion step enables a chemical conversion coating excellent in adhesiveness and corrosion resistance to be formed on or over the surface of the magnesium-containing metal material. Note that, before the surface conditioning treatment step, pretreatment steps such as degreasing, pickling, etching, desmutting, and paper polishing may be performed on the surface of the magnesium-containing metal material. These pretreatment steps can remove an oxide coating formed on the magnesium-containing metal material and oil content, contaminants, and the like adherent to the magnesium-containing metal material to clean up the surface. After the pretreatment steps, treatments may be performed, such as solvent cleaning and a steam treatment (also referred to as "hydrothermal treatment", "magnesium hydroxide coating forming treatment", or the like). These treatments can enhance adhesiveness between the magnesium-containing metal material and the chemical conversion coating, so that a magnesium-containing metal material with a coating having excellent corrosion resistance can be obtained. Note that as the above-mentioned steam treatment method, a well-known method can be used. Additionally, after the various pretreatment steps, the surface conditioning treatment step, the chemical conversion step, and the like, posttreatment steps may be performed, such as cleaning such as washing with water, drying, and coating, as appropriate. These pretreatments and posttreatments can be performed by well-known methods.

(Surface Conditioning Treatment Step)

The surface conditioning treatment step is a method in which the surface conditioning agent is contacted with a magnesium-containing metal material to treat the surface of the material. Examples of a method for contacting the surface conditioning agent include spray coating, dip coating, roll coating, curtain coating, and spin coating, or methods thereof combined as appropriate.

The temperature of the surface conditioning agent or the magnesium-containing metal material in the surface conditioning treatment step is usually 0° C. or more, may be 10° C. or more, and is usually 40° C. or less, may be 30° C. or less.

The time of contact between the surface conditioning agent and the magnesium-containing metal material is usually 1 second or more, and may be 5 seconds or more, or 10 seconds or more. Additionally, the time of contact therebetween is usually 10 minutes or less, and may be 5 minutes or less, 3 minutes or less, or 1 minute or less.

(Chemical Conversion Step)

The chemical conversion step is a method in which the magnesium-containing metal material that has been contacted with the surface conditioning agent is contacted with a surface treatment agent (a chemical conversion agent) to perform a chemical conversion on or over the surface thereof.

The chemical conversion agent is not particularly limited as long as the agent includes a phosphate ion and a calcium ion.

Examples of a phosphate ion supply source include phosphoric acid or water soluble phosphates. Additionally, examples of a calcium ion supply source include calcium hydroxide, calcium carbonate, or calcium nitrate.

Calcium ion concentration and phosphate ion concentration in the chemical conversion agent are not particularly limited as long as a chemical conversion coating including the crystalline particles of dibasic calcium phosphate can be formed on or over a magnesium-containing metal material. The phosphate ion concentration is usually 500 ppm or more, may be 1000 ppm or more, and is usually 20000 ppm or less, may be 10000 ppm or less. The calcium ion concentration is usually 100 ppm or more, may be 500 ppm or more, and is usually 10000 ppm or less, may be 5000 ppm or less.

The pH of the chemical conversion agent is usually 2.0 or more, may be 3.0 or more, or may be 4.0 or more, and is usually 5.0 or less, may be 4.5 or less. The pH adjuster for adjusting the pH of the chemical conversion agent is not particularly limited, and there can be used an acid component such as nitric acid, phosphoric acid, or sulfuric acid or an alkali component such as sodium hydroxide, sodium carbonate, aqueous ammonia, or ammonium hydrogen carbonate.

The method for the chemical conversion is not particularly limited, and examples of the method include methods such as spraying treatment, dipping treatment, electrolytic treatment, and pouring treatment. The temperature of the chemical conversion is usually 10° C. or more, may be 40° C. or more, or may be 70° C. or more, and is usually 100° C. or less, may be 90° C. or less.

In the chemical conversion, the time of contact between the magnesium-containing metal material and the surface treatment agent is usually 1 minute or more, may be 3 minutes or more, or may be 5 minutes or more, and is usually 60 minutes or less, may be 30 minutes or less, or may be 15 minutes or less.

Note that preferably, the chemical conversion step is immediately performed after the surface conditioning agent is contacted with the magnesium-containing metal material.

<Magnesium-Containing Metal Material>

The magnesium-containing metal material that is intended to be subjected to the surface conditioning treatment and the chemical conversion is a metal material that contains magnesium as a main component, such as a magnesium material or a magnesium alloy material. In the case of a magnesium alloy material composed of two metal components, it suffices that the material contains 50% by weight or more of magnesium, and, preferably, 80% by weight or more of magnesium. Additionally, in the case of a magnesium alloy material composed of three or more metal components, it suffices that magnesium is the largest in amount among the components. Examples of the kind of the magnesium alloy material include AZ91, AM60, ZK51, ZK61, AZ31, AZ61, and ZK60.

<Magnesium-Containing Alloy Material Provided with Coating>

Another embodiment of the present invention is a magnesium-containing metal material with a coating including a coating that includes particles of dibasic calcium phosphate and that is provided on or over a surface of a magnesium-containing metal material. Note that the magnesium-containing metal material with a coating may be one in which anti-rust oil or a sealing agent is applied on the coating including the dibasic calcium phosphate particles or may be one that is further provided with a paint film on the coating including the dibasic calcium phosphate particles.

The dibasic calcium phosphate particles included in the coating are crystalline particles. The dibasic calcium phosphate particles may be of monetite or brushite, or may include both of them. Additionally, when the particles include both thereof, a content ratio between them is not particularly limited.

In addition, the coating including the crystalline dibasic calcium phosphate particles has a uniform and dense structure. Thus, the coating has excellent adhesiveness and corrosion resistance. Note that it can be confirmed by X-ray diffraction (XRD) that the dibasic calcium phosphate particles are crystalline particles.

The average primary particle size of the crystalline particles of dibasic calcium phosphate in the coating is 0.7 μm or more, may be 1 μm or more, 2 μm or more, or 3 μm or more, and is 25 μm or less, may be 20 μm or less, 15 μm or less, or 10 μm or less. When the coating includes the crystalline dibasic calcium phosphate particles having an average primary particle size within the above range, the coating has excellent adhesiveness and corrosion resistance.

In addition, the particle size distribution standard deviation of the dibasic calcium phosphate particles in the coating is 5 or less, may be 3 or less, 1.5 or less, or 1 or less. When the coating includes the crystalline dibasic calcium phosphate particles having a standard deviation within the above range, the coating has a more uniform and dense structure.

The average primary particle size can be obtained by observation through a scanning electron microscope. Specifically, maximum and minimum sizes of randomly selected 100 crystalline dibasic calcium phosphate particles are respectively measured to calculate an average value of all the sizes, and the average value is defined as an average primary particle size. Additionally, the particle size distribution standard deviation can be obtained by measuring the sizes of randomly selected 100 crystalline dibasic calcium phosphate particles to create a particle size distribution.

As means for adjusting the dibasic calcium phosphate particles in the coating so as to have the above-mentioned size and standard deviation, there may be mentioned implementation of the surface conditioning treatment step and the chemical conversion step.

The coating formed on or over the magnesium-containing metal material preferably has high coverage, from the viewpoint of corrosion resistance. The coverage is usually 90% or more, and may be 95% or more. The coverage can be calculated by scanning electron microscopic observation, and can be calculated by measuring an area ratio between a bare surface of the magnesium-containing metal material and a portion thereof covered with the coating, either visually or by image analysis.

The amount of the coating formed on or over the magnesium-containing metal material is usually 0.5 $g/m^2$ or more, may be 1.0 $g/m^2$ or more, and is usually 10 $g/m^2$ or less, may be 5 $g/m^2$ or less. The magnesium-containing metal material provided with the coating including the crystalline dibasic calcium phosphate and having a coating amount within the above range has favorable adhesiveness and corrosion resistance.

The amount of the coating including the crystalline dibasic calcium phosphate particles can be calculated by quantifying the amount of calcium and the amount of phosphorus by X-ray fluorescence spectrometry analysis and converting to $CaHPO_4$.

As a coverage increasing method and a coating-amount increasing method, there may be mentioned a method of performing the surface conditioning treatment step by the surface conditioning agent before the chemical conversion step, as well as a method of adjusting a treatment time of the chemical conversion step.

In addition, the thickness of the coating is not particularly limited, but, from the viewpoint of corrosion resistance, it is usually 1 μm or more, may be 2 μm or more, and is usually 15 μm or less, may be 10 μm or less. The thickness of the coating can be obtained by laser microscopic observation of a cross-sectional shape of the coating.

The surface of the coating formed on or over the magnesium-containing metal material is preferably uniform, but may have a predetermined roughness. For example, the coating surface may have an arithmetic average surface roughness (Ra) of 7 μm or less or 4 μm or less.

When the coating including the dibasic calcium phosphate particles is a porous coating, pores of the coating can be filled by applying anti-rust oil or a sealing agent on the coating including the dibasic calcium phosphate particles, whereby higher corrosion resistance can be exhibited.

The above paint film can be formed by performing painting on the coating including the dibasic calcium phosphate particles formed on or over the surface of the magnesium-containing metal material. The method for the painting is not particularly limited, and there may be mentioned well-known methods such as, for example, electropaint (e.g., cation electropaint), solvent painting, and powder painting. In this manner, forming a paint film on the coating including the dibasic calcium phosphate particles enables exhibition of excellent adhesiveness (excellent adhesiveness between the magnesium-containing metal material and the paint film).

The thickness of the paint film is not particularly limited, but is from 5 to 30 μm on average, and may be from 8 to 25 μm.

EXAMPLES

The present invention will be described in more detail hereinbelow by Examples.

<Magnesium Alloy Material>

As a magnesium alloy material, a plate material of ASTM (American Society for Testing and Materials)-AZ31 was used. Additionally, the plate material was subjected to the following pretreatments before a surface conditioning treatment described later. Specifically, an alkaline degreasing agent (FINE CLEANER MG 110E, manufactured by Nihon Parkerizing Co., Ltd.,) heated to 65° C. was sprayed on a surface of the plate material for 120 seconds, followed by washing with water. Subsequently, the surface of the plate material was physically polished by sandpaper while applying deionized water to the surface to be polished, then washed with deionized water, and dried with hot air.

<Preparation of Surface Conditioning Agent and Surface Treatment Agent>

One part by weight of carboxymethyl cellulose was dissolved in 55 parts by weight of deionized water. To the dissolved product was added 24 parts by weight of monetite or brushite. The resulting mixture was stirred, and then wet-pulverized using a DYNO-MILL pulverizer (alkali glass beads: 01 mm). A particle size distribution of a solid content in the pulverized mixture (a suspension having a solid content concentration of 30%) was measured by a microtrac analyzer UPA-EX150 manufactured by Nikkiso Co., Ltd., whereby $D_{50}$ and $D_{90}$ were obtained. As a result, the $D_{50}$ was 0.45 μm, and the $D_{90}$ was 0.9 μm.

Furthermore, sodium pyrophosphate and trisodium phosphate, respectively, were added to the above suspension so as to have final concentrations of 250 ppm and 200 ppm to prepare surface conditioning agents of Examples 1 to 8. Additionally, Table 1 shows the kinds and concentrations of dibasic calcium phosphate particles used to prepare the respective surface conditioning agents.

TABLE 1

| Example | Kind | Concentration (g/L) |
|---|---|---|
| 1 | Monetite | 10 |
| 2 | Brushite | 6 |
| 3 | Monetite | 1 |
| 4 | Brushite | 2 |
| 5 | Brushite | 3 |
| 6 | Monetite | 3 |
| 7 | Monetite | 20 |
| 8 | Brushite | 0.7 |

Additionally, 75% phosphoric acid and calcium nitrate tetrahydrate, respectively, were dissolved in deionized water so as to have final concentrations of 7 g/L and 12 g/L, and the pH of the resulting solution was adjusted to 3.5 by sodium hydroxide to prepare a surface treatment agent (a chemical conversion agent).

<Surface Conditioning Treatment and Chemical Conversion>

The polished plate material was dipped in each surface conditioning agent at 25° C. for 30 seconds to perform a surface conditioning treatment. After that, the plate material was dipped in the chemical conversion agent for 15 minutes to perform a chemical conversion. Subsequently, the plate material was washed with deionized water and dried with hot air to produce a magnesium alloy material with a coating. Additionally, Table 2 shows temperatures of each chemical conversion agent used for the chemical conversion.

<Measurement of Coverage of Magnesium Alloy Material Provided with Coating>

The surface of the coating formed on the magnesium alloy material was observed through a scanning electron microscope to obtain, as a coverage, a percentage of an area occupied by the coating with respect to the magnesium alloy material. Table 2 shows results.

<Identification of Film Crystal System>

The coating formed on the magnesium alloy material was measured by an X-ray diffraction technique to identify a crystal system thereof. Table 2 shows results.

<Measurement of Amount of Coating>

A phosphorus content (a phosphorus adhesion amount) in the coating formed on the magnesium alloy material was measured by an X-ray fluorescence spectrometry analyzer, and converted to a coating amount. Conversion to a coating amount was made based on the identification results of the crystal system of the coating by the X-ray diffraction technique. For example, when the coating was identified to be 100% brushite, a conversion from a phosphorus adhesion amount P to a coating amount W was calculated by Formula: W=P×172.1/31.0 by using the atomic weight of phosphorus: 31.0 and the molecular weight of brushite: 172.1. Table 2 shows results.

<Measurement of Average Particle Size of Monetite Crystal or Brushite Crystal in Coating and Measurement of Particle Size Distribution Standard Deviation>

The surface of the coating formed on the magnesium alloy material was observed through a scanning electron microscope, and particle sizes of randomly selected 100 crystal particle samples were measured to calculate an average particle size and a particle size distribution standard deviation. Table 2 shows results. It should be noted that the particle size of each sample was represented by an average value between maximum and minimum sizes of the measured sample. In addition, the particle size distribution standard deviation was 5 or less for both.

<Evaluation of Corrosion Resistance>

The magnesium alloy material provided with the coating was dipped in a 5% aqueous solution of sodium chloride at 40° C. for 24 hours, followed by washing with water and air-drying, and appearance evaluation was made according to the following judgment criteria. Table 2 shows results.

(Judgment Criteria)

5 points: no rust is found.

4 points: there are several rust spots.

3 points: there are many rust spots, or rust is found at an area ratio of below 20%.

2 points: rust is found at an area ratio of 20% or more, but not the entire surface is covered with rust.

1 point: the entire surface is covered with rust.

<Evaluation of Adhesiveness>

The magnesium alloy material with the coating was subjected to electropaint to evaluate adhesiveness of a paint film to the magnesium alloy material. Using a cationic electropaint agent "GT-10LF" manufactured by Kansai Paint Co., Ltd., a paint film was formed under conditions of a paint agent temperature of 28° C. and a voltage of 200 V. After that, the alloy material was washed with water, and baked at 150° C. for 20 minutes to obtain a magnesium alloy material provided with a paint film having a dry film thickness of 20 μm.

The magnesium alloy material provided with the coating was dipped in deionized water at 40° C., and, after 240 hours, was cross-cut into a grid pattern by a paper cutter. A cellophane tape was attached to cross-cut portions, and a tape peel-off test was performed. Note that the cross-cutting into the grid pattern was performed in such a manner that 11 parallel lines were crossed at right angles at intervals of 1 mm to form 100 squares. After peeling off the tape, the number of squares peeled off was counted, and adhesiveness was evaluated according to the following judgment criteria. Table 2 shows results.

(Judgment Criteria)

5 points: there was no peel-off.

4 points: only edges of the squares peeled off, but there was no peel-off of the entire parts thereof.

3 points: 1 to 20 squares peeled off.

2 points: 21 to 50 squares peeled off.

1 point: 51 or more squares peeled off.

TABLE 2

| Magnesium alloy material with coating | Surface conditioning agent | Temperature of chemical conversion agent (° C.) | Characteristics of Coating: Crystal system of coating | Coverage (%) | Amount of adhesion (g/m$^2$) | Average particle size (μm) | Performance of coating: Corrosion resistance | Adhesiveness of paint film |
|---|---|---|---|---|---|---|---|---|
| No. 1 | Example 1 | 70 | Mixed crystal of brushite/monetite | 100 | 1.1 | 1.2 | 4 | 5 |
| No. 2 | Example 2 | 60 | Brushite | 100 | 1.6 | 2.1 | 5 | 5 |
| No. 3 | Example 3 | 75 | Monetite | 91 | 4.8 | 18 | 4 | 4 |
| No. 4 | Example 4 | 60 | Brushite | 95 | 3.9 | 10 | 5 | 5 |
| No. 5 | Example 5 | 60 | Brushite | 100 | 2.5 | 4.5 | 5 | 5 |
| No. 6 | Example 6 | 75 | Monetite | 100 | 2.8 | 6.3 | 5 | 5 |
| No. 7 | Example 7 | 70 | Mixed crystal of brushite/monetite | 100 | 0.9 | 0.9 | 3 | 5 |
| No. 8 | Example 8 | 55 | Brushite | 93 | 4.2 | 22 | 3 | 3 |

As shown in Table 2, all of the Examples have been shown to have excellent corrosion resistance and adhesiveness.

Comparative Example 1

Using the polished plate material, the above corrosion resistance evaluation and the above adhesiveness evaluation were performed without performing the surface conditioning treatment and the chemical conversion, whereby respective evaluation results of 1 point were obtained.

It should be noted that while the present invention has been described in detail with reference to the specific Examples, it is obvious to those skilled in the art that various changes and modifications can be made without departing from the spirit and scope of the invention.

The invention claimed is:

1. A method for manufacturing a magnesium material or magnesium alloy material with a coating, the method comprising: a step of contacting a magnesium material or a magnesium alloy material with a surface conditioning agent comprising particles of dibasic calcium phosphate; and a step of contacting the magnesium material or magnesium alloy material that has been contacted with the surface conditioning agent with a surface treatment agent including a phosphate ion and a calcium ion, wherein the coating comprises crystalline particles of dibasic calcium phosphate provided on or over a surface of a magnesium material or magnesium alloy material, the crystalline particles of dibasic calcium phosphate having an average particle size of from 0.7 μm to 25 μm and having a particle size distribution standard deviation of 5 or less, and the dibasic calcium phosphate being monetite and/or brushite, and wherein the particles of dibasic calcium phosphate included in the surface conditioning agent have a $D_{50}$ of from 0.1 μm to 0.8 μm.

2. The method for manufacturing a magnesium material or magnesium alloy material with a coating according to claim 1, further comprising a step of subjecting the magnesium material or magnesium alloy material by steam treatment to form a magnesium hydroxide coating on the magnesium material or magnesium alloy material before the step of contacting the magnesium material or the magnesium alloy material with the surface conditioning agent.

* * * * *